United States Patent [19]

Hayward et al.

[11] Patent Number: 4,949,047

[45] Date of Patent: Aug. 14, 1990

[54] SEGMENTED RFQ ACCELERATOR

[75] Inventors: Thomas D. Hayward, Tacoma, Wash.; Robert H. Hamm, Pleasanton, Calif.; Marco Johnson, Seattle, Wash.

[73] Assignees: The Boeing Company, Seattle, Wash.; AccSys Technology, Incorporated, Pleasanton, Calif.

[21] Appl. No.: 100,637

[22] Filed: Sep. 24, 1987

[51] Int. Cl.[5] ..... H05H 9/00

[52] U.S. Cl. ..... 328/233; 313/153; 313/160; 335/212; 335/298

[58] Field of Search ..... 328/233; 335/212, 298; 313/153, 160

[56] References Cited

U.S. PATENT DOCUMENTS

| | | | |
|---|---|---|---|
| 2,883,569 | 4/1959 | Kaiser et al. | 335/210 X |
| 3,284,744 | 11/1966 | Danby et al. | 335/210 |
| 3,356,976 | 12/1967 | Sampson et al. | 335/216 |
| 3,387,241 | 6/1968 | Audoin et al. | 335/210 |
| 3,431,523 | 3/1969 | Donadieu | 335/210 |
| 3,482,136 | 12/1969 | Herrera | 313/63 |
| 3,568,115 | 3/1971 | Wolfe | 335/210 |
| 4,089,045 | 5/1978 | Mars | 362/390 |
| 4,117,434 | 9/1978 | Logan | 335/213 |
| 4,381,490 | 4/1983 | Peters | 335/210 |
| 4,429,229 | 1/1984 | Gluckstern | 250/396 |
| 4,549,155 | 10/1985 | Halbach | 335/212 |

OTHER PUBLICATIONS

Wilson et al., "Mechanical Features of the Arts RFQ Linear Accelerator", (footnote—This work was supported by the US Dept of Defense, Defense Advanced Projects Agency, and Ballistic Missile Defence Advanced Technology Center.), 1981.

Accelerator Technology Division Personnel, "Los Alamos Scientific Laboratory Collection of Papers of the Radio-Frequency Quadrupole (RFQ) Linear Accelerator.", Mar. 1979 to Nov. 1980.

*Primary Examiner*—Palmer C. DeMeo

*Attorney, Agent, or Firm*—Christensen, O'Connor, Johnson & Kindness

[57] ABSTRACT

A segmented radio-frequency quadrupole accelerator (10) having a top segment (12), a bottom segment (14), a first side segment (16) and a second side segment (18), each segment having an elongated vane portion (20) arranged in diametrically-opposed pairs along a common longitudinal axis. Mounting arms (30) are integrally formed in the outer walls (28) of the vane portion (20), each end of each mounting arm (30) having a mounting surface (32) formed of a projection (34) having a surface (36) and an end surface (38) oriented at substantially right angles to cooperate with a mounting portion on an adjacent minor segment having a surface (44) and an end surface (46) oriented at right angles. Seals (48) having a C-shaped, cross-sectional configuration are placed between the mounting surfaces to maintain electrical contact between the segments. Fasteners (54) are securely fastened through oversized holes (52) in the segments to adjustably fasten the segments together. Shims (37) may be placed between the mounted surfaces to adjust the position of the vane tips A–D with respect to each other.

4 Claims, 2 Drawing Sheets

10
12
14
16
18
20
22
24
26
27
28

12
14
16
18
20
22
24
26
27
28
37
48
52
54
Z

X
Y
12
14
16
20
22
24
30
32
34
36
37
38
40
42
44
46
48
50

SEGMENTED RFQ ACCELERATOR

FIELD OF THE INVENTION

This invention relates to linear accelerators and, in particular, to a segmented radio-frequency quadrupole accelerator.

BACKGROUND OF THE INVENTION

In order to be usable in space, linear accelerators that utilize a radio-frequency quadrupole (RFQ) must be able to withstand the forces encountered during a rocket launch. In addition, it is desirable that RFQ accelerators be lightweight, easily fabricated, and easily adjusted for either space or ground applications and, more particularly, portable ground systems. Existing RFQ accelerators have failed to accomplish these goals and, thus, are unacceptable for these applications.

One of the major disadvantages of current RFQ accelerators is that they are constructed of very precisely made parts that are imprecisely mounted inside of an accelerator shell. Complex adjustment mechanisms are required to align the vane tips of the RFQ accelerator in the precise spatial relationship that is critical to achieving uniform field distributions in the four quadrants of the RFQ accelerator. Precision alignment is attained by repeated testing and readjustment of the position of the RFQ vane tips. This trial and error method is time consuming and difficult.

Another disadvantage of present RFQ accelerators is that prior adjustment mechanisms have usually relied on independently tensioning each of the four vanes and the resonator shell. During the alignment process, the tension developed in adjusting one vane causes distortion in the shape of the resonator shell and consequent misalignment of the other vanes. As a result, alignment is crude and imprecise. Consequently, maximum performance of the RFQ accelerator is difficult to achieve. Furthermore, because the adjustment mechanisms are under constant tension, they are inherently unstable and can easily go out of adjustment when vibrated.

In addition to alignment, the four RFQ vanes must be attached longitudinally along the RFQ resonator shell to have a good radio-frequency current contact for conducting the large currents necessary to excite the vane tips. Previously developed RFQ accelerators use either flexible welded joints or adjustment mechanisms with built-in contacts. These earlier configurations have the disadvantage of requiring two contact joints per vane, for a total of eight per RFQ accelerator, to permit adjustment of the vane in several directions while maintaining current contact. These additional contacts decrease the efficiency while increasing the weight, complexity, and cost of previous RFQ accelerators. Further, the current contact joints do not maintain contact when subjected to severe vibrational loads.

SUMMARY OF THE INVENTION

In accordance with the present invention, a segmented RFQ accelerator is provided. The accelerator comprises four elongated segments having radio-frequency conducting surfaces. Each elongated segment has an elongated vane portion lying parallel to the longitudinal axis of the segment and an elongated mounting portion lying parallel to the longitudinal axis of the segment. The elongated mounting portion has two longitudinally-oriented mounting surfaces for mounting and aligning the segments such that when all four of the segments are joined together, they are positioned in diametrically-opposed pairs along a common longitudinal axis with the vane portions oriented to face toward the common longitudinal axis. Radio-frequency contact between the mounting portions of the segments is maintained by elastic conductors running between the segments; and, a fastening mechanism that adjustably fastens the segments to one another.

In accordance with other aspects of the invention, the mounting portion comprised of the two longitudinally-oriented mounted surfaces for mounting and aligning the segments is preferably integrally formed with the vane portion.

In accordance with further aspects of the invention, the conductors that maintain radio frequency contact between the segments comprise a flexible, elongated, current-conducting seal located between each pair of adjacent segments. Preferably, the seals have a C-shaped, cross-sectional configuration.

In accordance with still other aspects of the invention, the fastening mechanism comprises a plurality of holes formed in each of the mounting portions for receiving fasteners, and a plurality of fasteners located in the holes, the fasteners having a diameter small than the diameter of the holes. In addition, the shims for adjusting the position of each of the elongated segments relative to one another are located between the mounting surfaces of the elongated segments.

In accordance with another aspect of the present invention, the four RFQ accelerator segments define two pairs of elongated segments with radio-frequency conducting surfaces—a pair of elongated major segments and a pair of elongated minor segments. Each elongated major segment has an elongated vane portion and a pair of elongated mounting arms projecting from the vane portion and lying parallel to the longitudinal axis of the segment. Each elongated minor segment has an elongated vane portion and an elongated mounting portion lying parallel to the axis of the segment. The elongated mounting arms of the elongated major segments are configured to mate with the elongated mounted portions of the elongated minor segments such that when joined together, the major segments and the minor segments are positioned in diametrically-opposed pairs along a common longitudinal axis with the vane portions oriented to face toward the common longitudinal axis.

As will be readily appreciated from the foregoing description, the present invention provides a segmented RFQ accelerator having a simplified structure. Each segment has mounting surfaces for mounting the segments to one another. This geometry provides a reference for machining and accurately checking the dimension of the alignment surfaces prior to final assembly. Once the mounting surfaces have been accurately ground for a precise fit, the four segments can be assembled with the flexible current-conducting seals in place without disturbing the final machined alignment. No dimensional changes occur during vibration of the system because very little stress has been placed on the material to achieve the alignment of the vanes.

The present invention also has the advantage that an RFQ accelerator can be fabricated from lightweight materials that can be copper-plated on the finished interior surfaces without disturbing the internal alignment. Small adjustments to the alignment along the length of the segments can be made by inserting shims between the mounting surfaces to account for the thickness of the plating. Alternatively, the ability to precisely machine and inspect the parts prior to assembly allows machining of the mounting surfaces to account for the plating thickness.

Numerous other advantages are also achieved. The number of radio-frequency, current contact joints is reduced from eight to only four. In addition, the elimination of the tension alignment mechanisms allows the C-shaped seals to be held in place without possible disruption of current flow due to shell distortion or vibrations. The present invention allows for mass production and ease of fabrication and assembly. In addition, all parts are mechanically adjustable with great accuracy to maintain the accelerator in a tuned state even when it is subjected to severe vibrational forces. The use of the four segments gives easier access for cooling the vane portions, and the outer walls are adaptable for mounting input loops and monitoring probes, as well as vacuum ports or vacuum pumping slots.

BRIEF DESCRIPTION OF THE DRAWINGS

The foregoing and other advantages and features of this invention will become more readily appreciated as the same becomes better understood by reference to the following detailed description when taken in conjunction with the accompanying drawings wherein.

DETAILED DESCRIPTION OF THE PREFERRED EMBODIMENT

Figure 1:
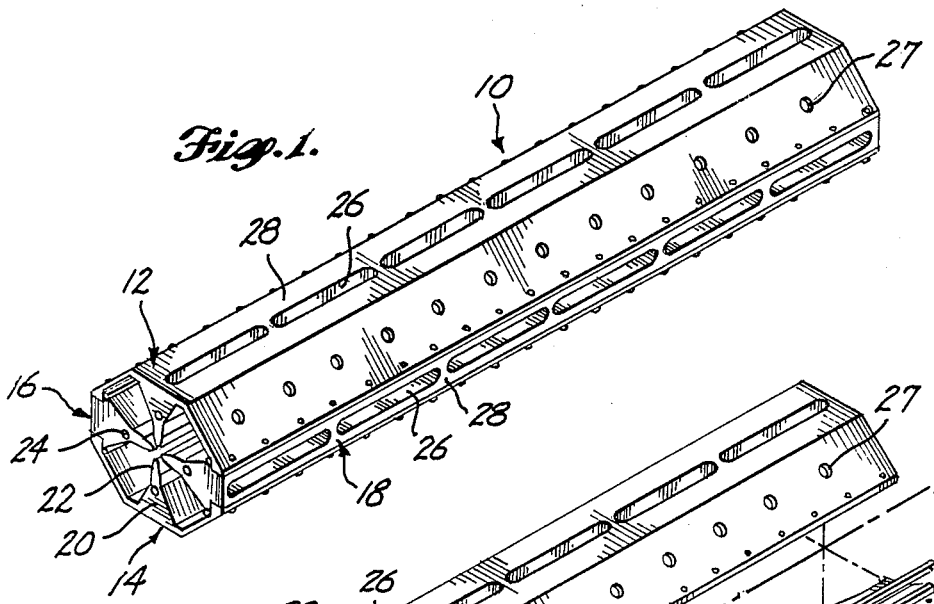
FIG. 1 is an isometric view of the segmented RFQ accelerator formed in accordance with the present invention.

FIG. 1 shows a preferred embodiment of a segmented RFQ accelerator 10 formed in accordance with the present invention. The accelerator 10 is constructed of two pairs of elongated segments—a major pair of segments comprised of a top segment 12 and a bottom segment 14, and a minor pair of segments comprised of a first side segment 16 and a second side segment 18. Each segment has an elongated vane portion 20 lying parallel to the longitudinal axis of the segment. When the segments are joined to one another, they are positioned in diametrically-opposed pairs along a common longitudinal axis Z (shown in FIG. 2) with the vane portions 20 oriented to face toward the Z axis.

Each vane portion 20 has a tip 22 that is shaped to cause particle acceleration along the Z axis when excited by radio-frequency current. A longitudinal ripple pattern is formed on the vane tips 22, and the ripple pattern has dimensions that are dependent on the application of the accelerator, i.e., the type of particle to be accelerated, the desired velocity of the particle, the bunching effect, etc. Generally, the tips 22 on the pair of major segments will have a pattern alternating with the pattern on the tips 22 of the minor segments. That is, the tips 22 on the major pair of segments will have periodic crests at the locations where the tips 22 on the minor pair of segments have troughs, and vice-versa.

When the accelerator 10 is assembled, the vane tips 22 define a small aperture through which the particles must pass. The clearance between the vane tips 22 must be carefully set to maintain a resonant radio-frequency current flow and maximum performance of the accelerator. Due to small temperature changes developed during operation of the accelerator, the vane portions 20 can expand, causing changes in the clearance of the tips 22 and a consequent deterioration in the accelerator performance. To stabilize the temperature and to minimize dimensional changes, longitudinal cooling passages 24 are formed within the vane portions 20 for conducting a cooling liquid, such as water, through the structure. In addition, cavities 26 that open to the outside of the accelerator 10 are formed in the outer walls 28 to reduce the weight of the vane portions 20, and slots 27 are formed to allow vacuum pumping of the cavity. In addition, the one-piece assembly of the accelerator 10 facilitates isotropic cooling and uniform expansion of the vane portions 20.

Preferably, the segments are constructed from aluminum, although other materials, such as copper, or even iron, steel or ceramic, may be used if weight is not a factor. The segments may be initially formed by casting, forging, or extrusion, or other suitable processes. After forming, the segments are machined to initial dimensions and the vane portions 20 and tips 22 are plated or coated with an electrically conductive material such as silver, copper or another good electrical conductor. The mounting surfaces may then be remachined to adjust for the additional plating thickness or irregularities in the plating, or shims may be used during final assembly, as described below. The plating thickness will vary generally between 0.001 inches to approximately 0.006 inches, depending on the amount of electrical current to be used and other variables.

When the accelerator 10 is assembled, as shown in FIG. 1, it has an octagonal, cross-sectional shape. Although the outer walls 28 may be shaped in any manner to suit the design purposes of the accelerator, preferably the outer walls 28 are flat. Flat outer walls are more adaptable for mounting devices, such as the radio-frequency power drives and monitoring probes, and they provide a ready reference for measuring size and fit during the fabrication process.

Figure 2:
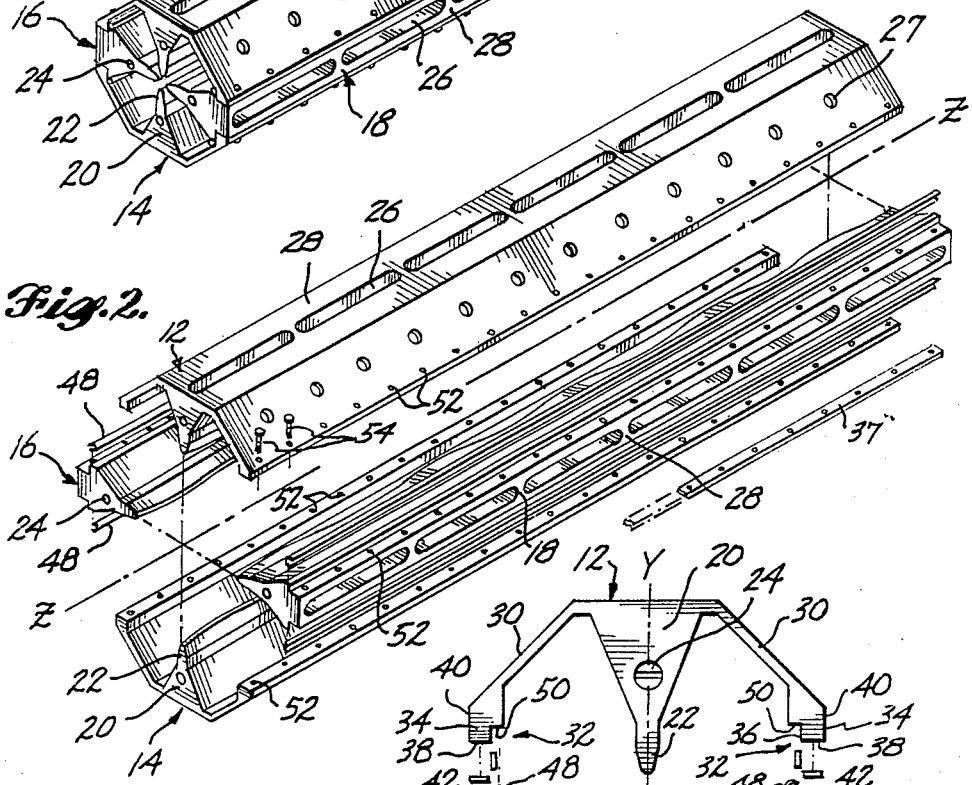
FIG. 2 is an exploded, isometric view of a preferred embodiment of the invention showing the elongated segments and the C-shaped seals.
Figure 3:
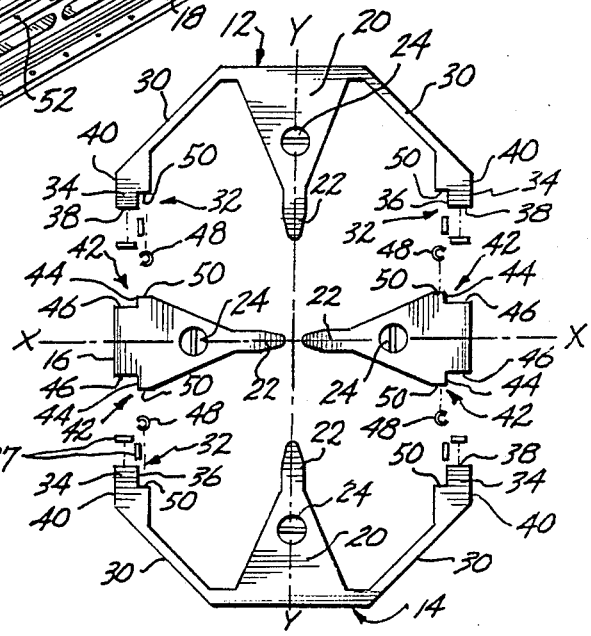
FIG. 3 is an exploded, side-elevational view of the present invention illustrated in FIG. 2.

FIGS. 2 and 3 show the interior features and the assembly of parts in greater detail. The major pair of segments, comprised of the top segment 12 and the bottom segment 14, each have a mounting portion comprising a pair of elongated mounting arms 30 that project from the vane portions 20 and lie parallel to the longitudinal axis of the segments. In the preferred embodiment, the mounting arms 30 are integrally formed with the outer walls 28 of the vane portions 20, though they may be separately constructed and attached during final assembly. In any event, when assembled in the manner hereinafter described, the outer surfaces of the mounting arms 30 and the outer walls 28 from which the arms project off each major segment define three of the eight surfaces of the octagonally shaped accelerator 10. An elongated mounting surface 32 is formed on the end of each mounting arm 30. In the preferred embodiment, the mounting surface 32 is comprised of a projection 34 having a surface 36 that faces the vane tips 22 and an end surface 38 oriented substantially at right angles with respect to the facing surface. The outside wall 40 of the projection 34 forms a part of the remaining outer walls 28 when the accelerator 10 is assembled, as shown in FIG. 1.

Similarly, the minor pair of segments, comprised of the first side segment 16 and the second side segment 18, each have an elongated mounting portion comprising two mounting surfaces 42 lying parallel to the longitudinal axis of the segments. Preferably, each mounting surface 42 has a surface 44 that faces away from the vane tips 22 and an end surface 46 oriented at substantially right angles with respect to the facing surface. Ideally, the mounting surfaces 42 are integrally formed with the vane portions 20. In addition, the facing surfaces 36, 44 of each of the major and minor pairs of segments lie in a plane that lies parallel to the plane (Y) that bisects the vane tips 22 of the major pair of segments, and the end surfaces 38, 46 of each of the major and minor pairs of segments lie in a plane that lies parallel to the plane (X) that bisects the vane tips 22 of the minor pair of segments, as shown in FIG. 3. When the segments 12, 14, 16, 18 are joined together, the mounting surfaces 32, 42 cooperate to permit adjustment of the segments with respect to each other. In particular, the facing surfaces 36 on the mounting arms 30 and the facing surfaces 44 on the first and second side segments 16, 18 slidably engage one another to permit adjustment of the segments along a transverse axis lying in the Y-plane. In the same manner, the end surfaces 38 on the major segments and the end surfaces 46 on the minor segments slidably engage one another to permit adjustment of the segments along a transverse axis lying in the X-plane.

In order to maintain radio-frequency current contact longitudinally along the entire surface of the vane portions 20, a current conducting elongated seal 48 is located between the mounting portions of each segment. In the preferred embodiment, an elongated seating surface 50 is formed in the mounting surfaces 32, 42 in each of the major and minor segments. The seating surfaces intersect the facing surfaces 36, 44 at right angles and lie on the opposite side of the facing surfaces from the end surfaces 38, 46. The seating surfaces hold the seal 48 in place and make electrical contact with the seal 48. The seal 48 is formed to have a C-shaped, cross-sectional configuration that compresses or flexes while maintaining electrical contact between the segments as their positions are adjusted. Preferably, the seal 48 is constructed of Inconel tubing, which is coated with copper or good electrical conductor. The tube may be slit longitudinally to reduce the force required to compress the seal. Other flexible current conducting contact may also be used.

As shown in FIG. 2, each of the segments has a plurality of holes 52 for receiving fasteners 54 that securely fasten the segments together. The diameter of the holes in the top segment 12 and the bottom segment 14 are larger than the diameter of the fasteners 54 to permit minor adjustment in the position of the segments. Preferably, the fasteners 54 are threaded bolts and the holes 52 in the first and second side segments 16, 18 are threaded to receive the bolts. The position of the segments may be adjusted by loosening the fasteners 54 and sliding the respective segments. Movement between the facing surfaces 36, 44 of the major segments and the minor segments along an axis lying in the Y-plane may require shims 37 to be inserted between the end surface 38 on the major segments and the end surface 46 on the minor segments to maintain the segments in their new positions when the fasteners 54 are retightened. Similarly, movement along an axis lying in the X-plane may require shims to be inserted between the facing surfaces 36 and 44 to maintain the segments in their new positions when the fasteners 54 are retightened. The shims 37 can be fabricated from stainless steel or other shim stock and will have the required taper and length to bring the segments into alignment. Alternatively, the surfaces may be remachined after plating and initial alignment to achieve a final fit.

Figure 4:
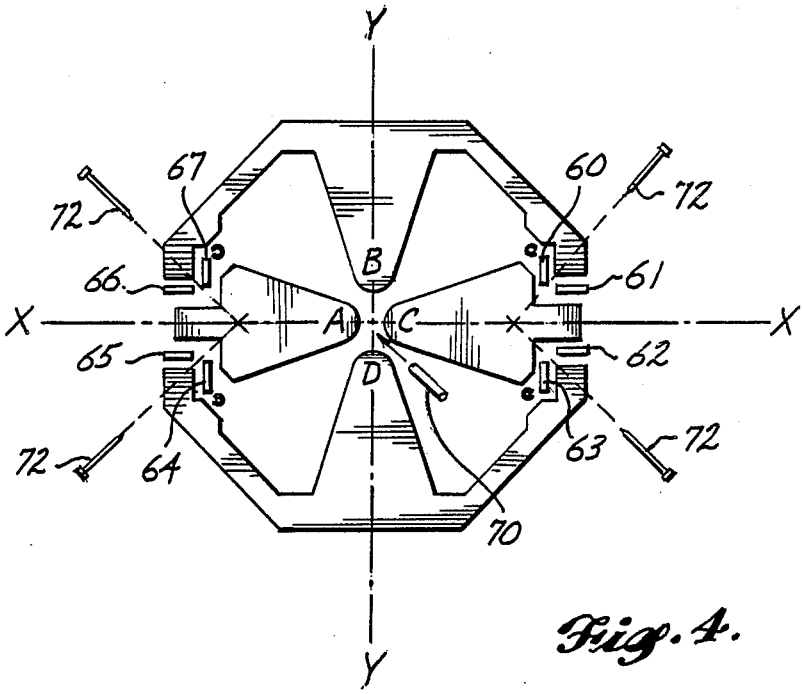
FIG. 4 is an exploded, cross-sectional view of the segmented RFQ accelerator formed in accordance with the present invention.

With reference to FIG. 4, the four pole tips represented by surfaces A, B, C and D can be moved relative to each other by changing the sizes of the shims 60–67 in such a way that the stress pattern around the assembly does not change. This is crucial to achieving an accurate position of the pole tips. In addition, it also reduces the time required to achieve the final pole positions and simplifies calculating the required shim dimension to produce a desired pole position.

Typically, the pole tips A–D are adjusted to achieve uniform spacing of the correct distance between each of the pole tips. The correct distance is required to achieve a resonant frequency, while the uniformity of the distance between the pole tips is required to maintain the accelerating quadrupole field and suppress an undesirable dipole field. In some applications, the spacing between the pole tips could be used to introduce a controlled dipole beam steering field.

The gap between the vane tips is measured by inserting a precision pin gauge 70 in each gap and recording the gap size. The difference between the measured gap size and the desired gap size determines the change in shim size. For instance, if it is desired to move vane tip A up a distance d relative to all the other pole tips, the thickness of shim 66 would be reduced by the amount d and the thickness of shim 65 would be increased by the amount d. Similarly, to move the vane tip A down by an amount d, one would increase the thickness of shim 66 by an amount d and decrease the thickness of shim 65 by an amount d. The same procedure is followed to perform position changes on the vane tips B, C and D, with the thickness of the corresponding shims being changed as described above. To reposition a vane tip so as to change the gap between the vane tip and a first adjacent vane tip while maintaining the original gap between the vane tip and a second adjacent vane tip requires movement of the vane tip at a 45 degree diagonal relative to the X or Y axis.

By way of example, if it is desired to reposition vane tip C so as to reduce the gap between vane tips B and C without changing the gap between vane tips D and C, vane tip C would have to move along a 45 degree diagonal toward vane tip B and parallel to the surface of vane tip D. This is accomplished by reducing the thickness of shim 61 by an amount of distance d times the square root of 2, while the shims 60, 62 and 63 are increased by the amount of d times the square root of 2. Similar shimming procedures can be used to open or close the gaps between any adjacent vane tips.

Another technique for moving the vane tips is to eliminate the use of shims by initially machining all of the reference surfaces with excess material. After the initial assembly and measurement of the gaps, the reference surfaces can then be machined to their final dimensions in a manner similar to that used to change the shim thickness without changing the stress pattern around the assembly.

In order to avoid unequal stresses on the segments, it is important that the fasteners 72 be positioned in such a way as to force the mounting surfaces of each vane against each other with an equal amount of force. One method of accomplishing this is by positioning the axis of the fasteners at an angle of 45 degrees with respect to the two mounting surfaces which the fasteners 72 clamp together, as illustrated in FIG. 4. Other configurations can also be used.

While a preferred embodiment of the invention has been illustrated and described, it will be appreciated that various changes can be made therein without departing from the spirit and scope of the invention. For example, the segments can be constructed to have a temperature compensated structure or fabricated from carbon fiber layers that have a zero coefficient of expansion to reduce the cooling required from the cooling passages in the vane portions. Consequently, the invention can be practiced otherwise than as specifically described herein.

The embodiments of the invention in which an exclusive property or privilege is claimed are defined as follows:

1. A segmented RFQ accelerator comprising:

(a) a pair of elongated major segments with radio-frequency conducting surfaces, each of said major segments having:

(i) an elongated vane portion lying parallel to the longitudinal axis of the segment; and (ii) a pair of elongated mounting arms projecting from said vane portion and lying parallel to the longitudinal axis of the segment, each of said mounting arms having a mounting surface;

(b) a pair of elongated minor segments having radio-frequency conducting surfaces, each of said minor segments having:

(i) an elongated vane portion lying parallel to the longitudinal axis of the segment; and (ii) an elongated mounting portion lying parallel to the longitudinal axis of the segment, said mounting portion being formed to have two mounting surfaces, each of said mounting surfaces of said elongated mounting portions being aligned with a respective one of the mounting surface on said elongated mounting arms on said first pair of elongated major segments such that when said first pair of elongated major segments and said second pair of elongated minor segments are joined together, said major segments and said minor segments are positioned in diametrically-opposed pairs along a common longitudinal axis, and said vane portions are oriented to face toward said common longitudinal axis;

(c) four flexible seals, one positioned between each mounting surface of the elongated mounting portions and its respective aligned mounting surface of the elongated mounting arms, for maintaining radio-frequency contact between said mounting surfaces; and (d) fastening means for adjustably joining said major segments and said minor segments to one another.

2. The accelerator of claim 1, wherein said flexible seals are elongated current-conducting seals having a compressible, C-shaped, cross-sectional configuration.

3. The accelerator of claim 1, wherein said coupling means comprises a plurality of oversized holes formed in each of said mounting portions for receiving fasteners and a plurality of fasteners mounted in said oversized holes.

4. The accelerator of claim 1, further comprising one or more shims insertable between said mounting surfaces for adjusting the position of each of said elongated segments relative to one another.

* * * * *

UNITED STATES PATENT AND TRADEMARK OFFICE

CERTIFICATE OF CORRECTION

PATENT NO. : 4,949,047

DATED : August 14, 1990

INVENTOR(S) : Thomas D. Hayward, et al.

It is certified that error appears in the above-identified patent and that said Letters Patent is hereby corrected as shown below:

On the title page:

| | |
|---|---|
| "Inventors" [75] | Delete "H." in "Robert H. Hamm" and insert therefor --W.-- |
| "References Cited" [56] | Delete "Defence" and insert therefor --Defense-- |
| "Abstract" [57] | After "at" insert --substantially-- |

Signed and Sealed this

Thirty-first Day of March, 1992

*Attest:*

HARRY F. MANBECK, JR.

*Attesting Officer*

*Commissioner of Patents and Trademarks*